US006739246B2

(12) United States Patent
Lan

(10) Patent No.: US 6,739,246 B2
(45) Date of Patent: May 25, 2004

(54) EXTENDABLE AUTO PRINTING AND DRYING MACHINE

(76) Inventor: Chin-Wang Lan, PO Box 82-144, Taipei (TW)

( * ) Notice: Subject to any disclaimer, the term of this patent is extended or adjusted under 35 U.S.C. 154(b) by 0 days.

(21) Appl. No.: 10/265,119

(22) Filed: Oct. 7, 2002

(65) Prior Publication Data

US 2004/0065220 A1 Apr. 8, 2004

(51) Int. Cl.[7] ..... B41F 15/04
(52) U.S. Cl. ..... 101/115; 101/126; 101/424.1
(58) Field of Search ..... 101/114, 115, 101/116, 117, 118, 123, 124, 126, 129, 424.1, 44

(56) References Cited

U.S. PATENT DOCUMENTS 2,359,825 A * 10/1944 Campbell ..... 101/115
2,846,946 A * 8/1958 Schwarzberger ..... 101/115
4,903,592 A * 2/1990 Ericsson ..... 101/115
5,090,311 A * 2/1992 Brasa ..... 101/115
5,239,613 A * 8/1993 Motev et al. ..... 392/412
5,553,536 A * 9/1996 Van Os ..... 101/44

* cited by examiner

*Primary Examiner*—Ren Yan
(74) *Attorney, Agent, or Firm*—Leong C. Lei

(57) ABSTRACT

An extendable auto printing and drying machine is constructed to include two end tables, and adjustable number of rectangular machine tables alternatively reversely arranged between the end tables, each rectangular machine table having a printer and dryer unit formed of a printing module and a drying module at two sides, a transmission chain loop provided in the rectangular machine tables and the end tables rotatable by an external motor drive, and a plurality of carriages respectively installed in transmission chain loop, the carriage each having a workpiece carrier adapted to carry a respective workpiece for printing and drying by the printing modules and drying modules of the printer and dryer units of the rectangular machine tables when the transmission chain loop rotated.

1 Claim, 6 Drawing Sheets

EXTENDABLE AUTO PRINTING AND DRYING MACHINE

BACKGROUND OF THE INVENTION

1. Field of the Invention

The present invention relates to a printing and drying machine and, more particularly, to an extendable auto printing and drying machine that can be conveniently adjusted subject to the desired capacity.

2. Description of the Related Art

FIG. 6 shows a conventional auto-rotary printer for printing T-shirts and various cut-pieces. This auto-rotary printer comprises a driving mechanism A at the center, and a plurality of printing nodules B respectively located on the radial rod members of the driving mechanism A. A circular conveyer system is provided below the printing modules B, carrying a plurality of workpiece carriers. The circular conveyer system is rotated intermittently. Upon each stroke of the motion of the circular conveyer system, the driving mechanism A is operated to lower the printing modules B, thereby causing the printing modules B to print the desired printing on the T-shirt or cut-piece on each workpiece carrier. The printed T-shirts or cut-pieces are further delivered through a drying unit and then well dried. This design of auto-rotary printer is not extendable, i.e., the number of the printing modules cannot be reduced or increased subject to the desired capacity. Further, this design of auto-rotary printer requires much installation space.

SUMMARY OF THE INVENTION

The present invention has been accomplished under the circumstances in view. It is main object of the present invention to provide an auto machine that automatically print and dry the loaded workpieces. It is another object of the present invention to provide an auto printing and drying machine, which can be conveniently adjusted subject to the desired capacity. It is still another object of the present invention to provide an extendable auto printing and drying machine, which is suitable for printing foaming and elastic paste on the workpieces. To achieve these and other objects of the present invention, the extendable auto printing and drying machine comprises two end tables, and adjustable number of rectangular machine tables alternatively reversely arranged between the end tables, each rectangular machine table having a printer and dryer unit formed of a printing module and a drying module at two sides, a transmission chain loop provided in the rectangular machine tables and the end tables rotatable by an external motor drive, and a plurality of carriages respectively installed in transmission chain loop, the carriage each having a workpiece carrier adapted to carry a respective workpiece for printing and drying by the printing modules and drying modules of the printer and dryer units of the rectangular machine tables when the transmission chain loop rotated. Further, the drying module of each printer and dryer unit uses infrared light source as heating source for drying the workpiece.

DETAILED DESCRIPTION OF THE PREFERRED EMBODIMENT

Figure 1:
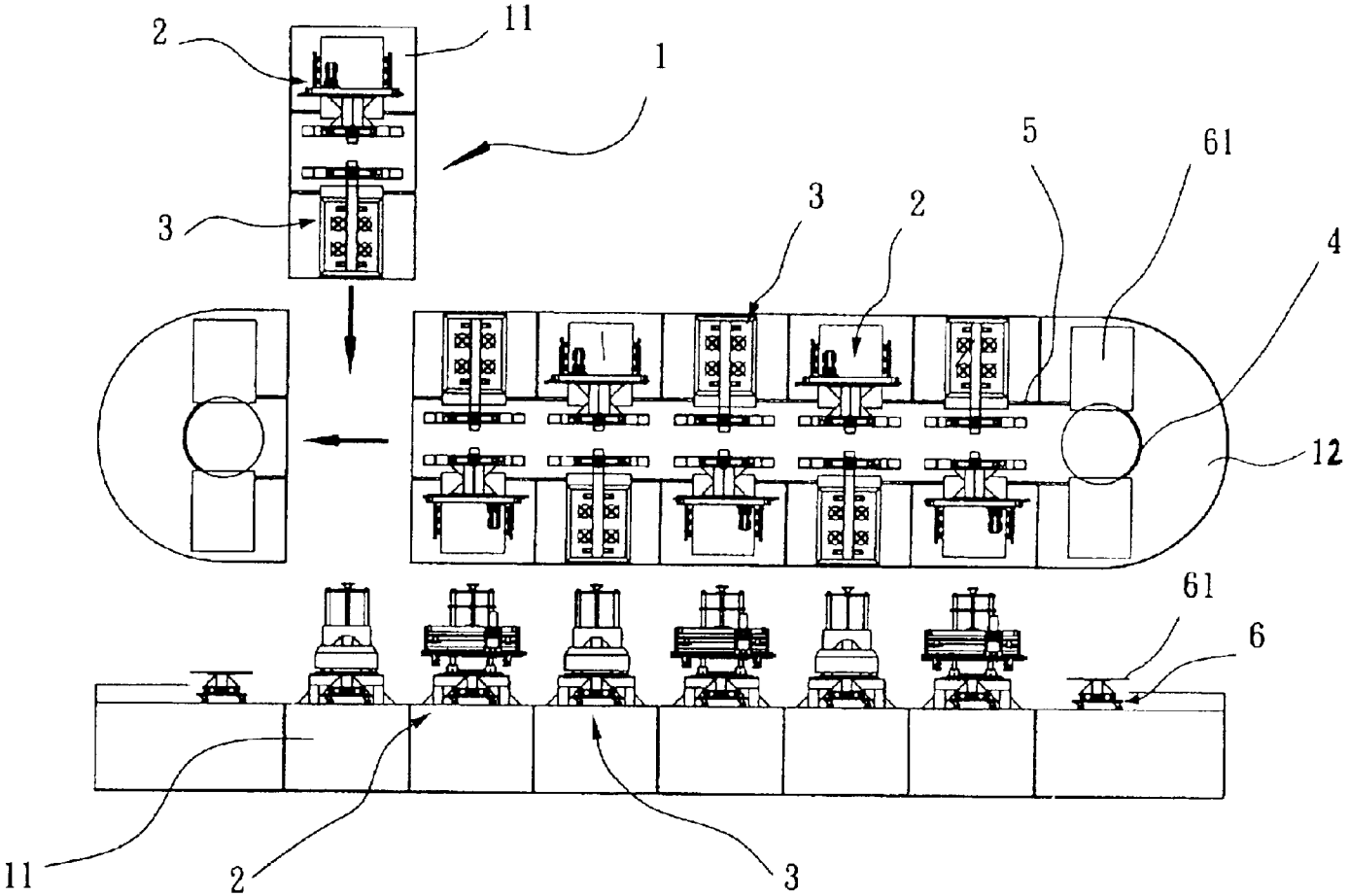
FIG. 1 is schematic top and front plain views showing an extension action of the present invention.
Figure 2:
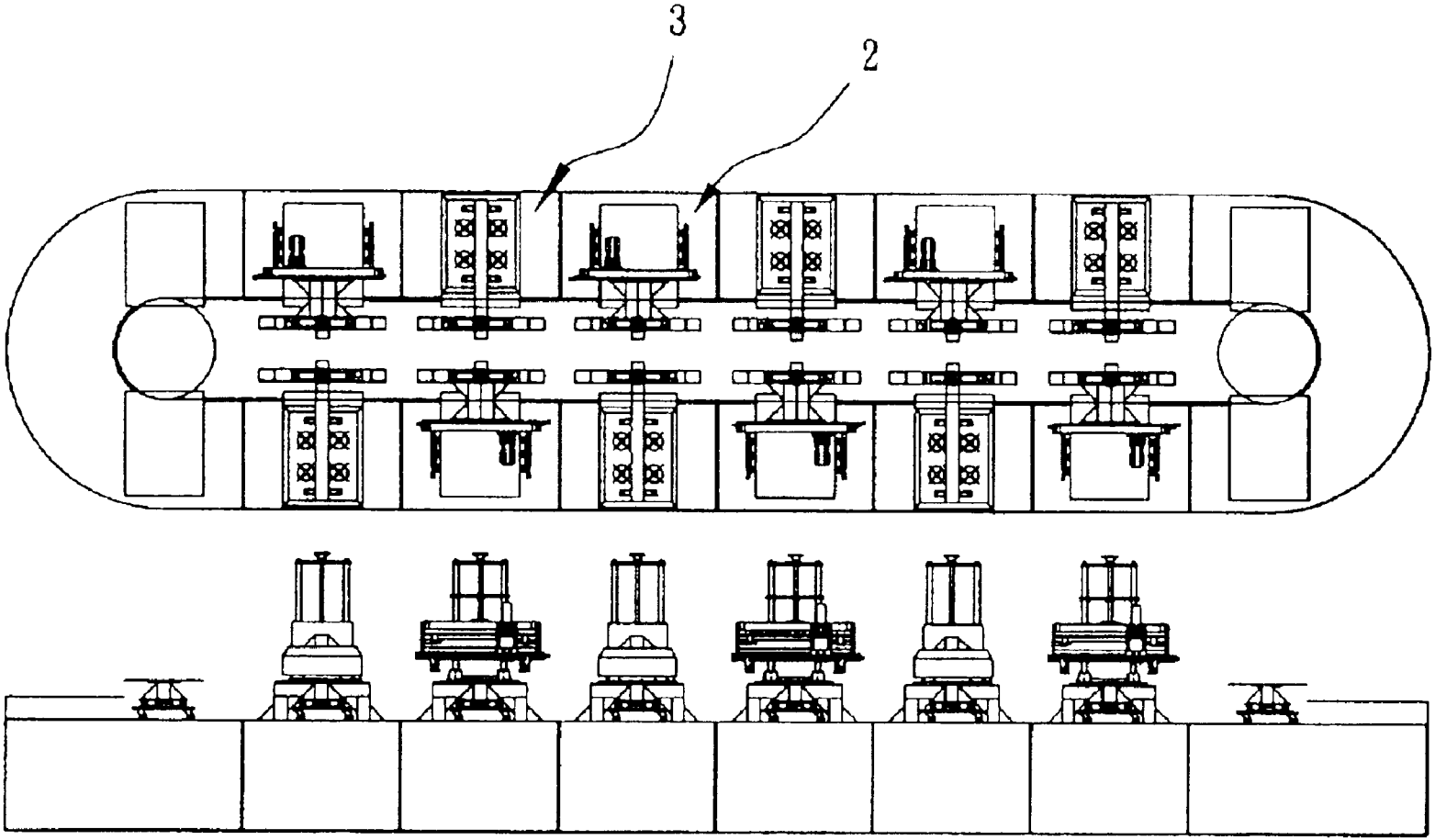
FIG. 2 is schematic top and front plain views, showing an extendable auto printing and drying machine arranged according to the present invention.

Referring to FIGS. 1 and 2, an extendable auto printing and drying machine in accordance with the present invention is shown comprised of a plurality of rectangular machine tables 11, and two semicircular end tables 12. Each rectangular machine table 11 comprises a printer and dryer unit 1. The printer and dryer unit 1 comprises a printing module 2 and a drying module 3 bilaterally arranged at the top side. The rectangular machine tables 11 are alternatively reversely arranged in a line between the semicircular end tables 12. The rectangular machine tables 11 and the end tables 12 each have a transmission chain mechanism 5. When rectangular machine tables 11 and the end tables 12 arranged together, the transmission chain mechanisms 5 form a transmission chain loop, which is coupled to a motor drive (not shown). A plurality of carriages 6 are respectively installed in the transmission chain mechanisms 5. Each carriage 6 has a workpiece carrier 61 adapted to carry a piece of cloth or clothe for printing. Further, the drying module 3 uses infrared light source to dry printed articles for the advantage of being not to cause foaming paste, nylon paste, or elastic paste to melt.

When the extendable auto printing and drying machine started, the transmission chain loop of the transmission chain mechanisms 5 is intermittently rotated to move carriages 6 over the printer and dryer units 1, for enabling the workpieces to be printed by the printing modules 2 of the printer and dryer units 1 and dried by the drying modules 3 of the printer and dryer units 1.

Figure 3:
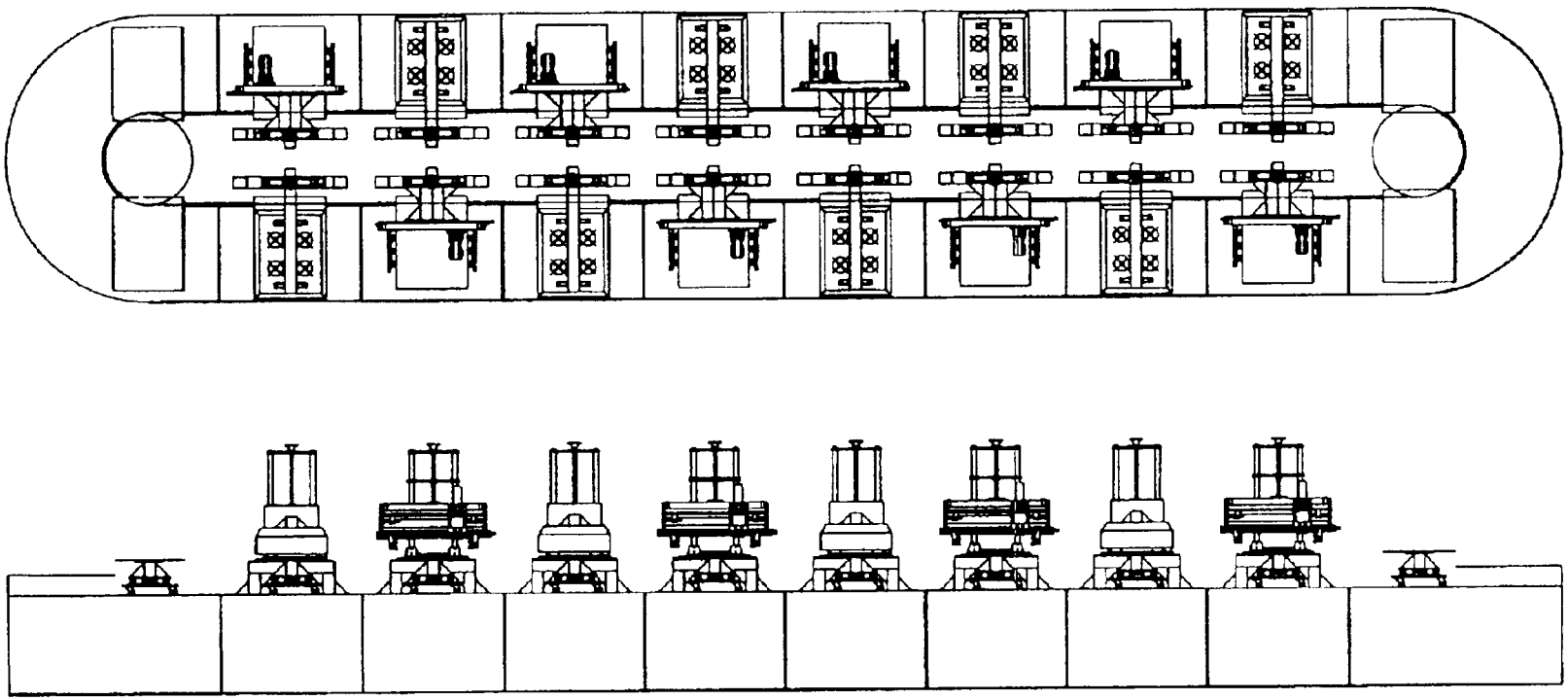
FIG. 3 is similar to FIG. 2 but showing the number of the rectangular machine table increased.
Figure 4:
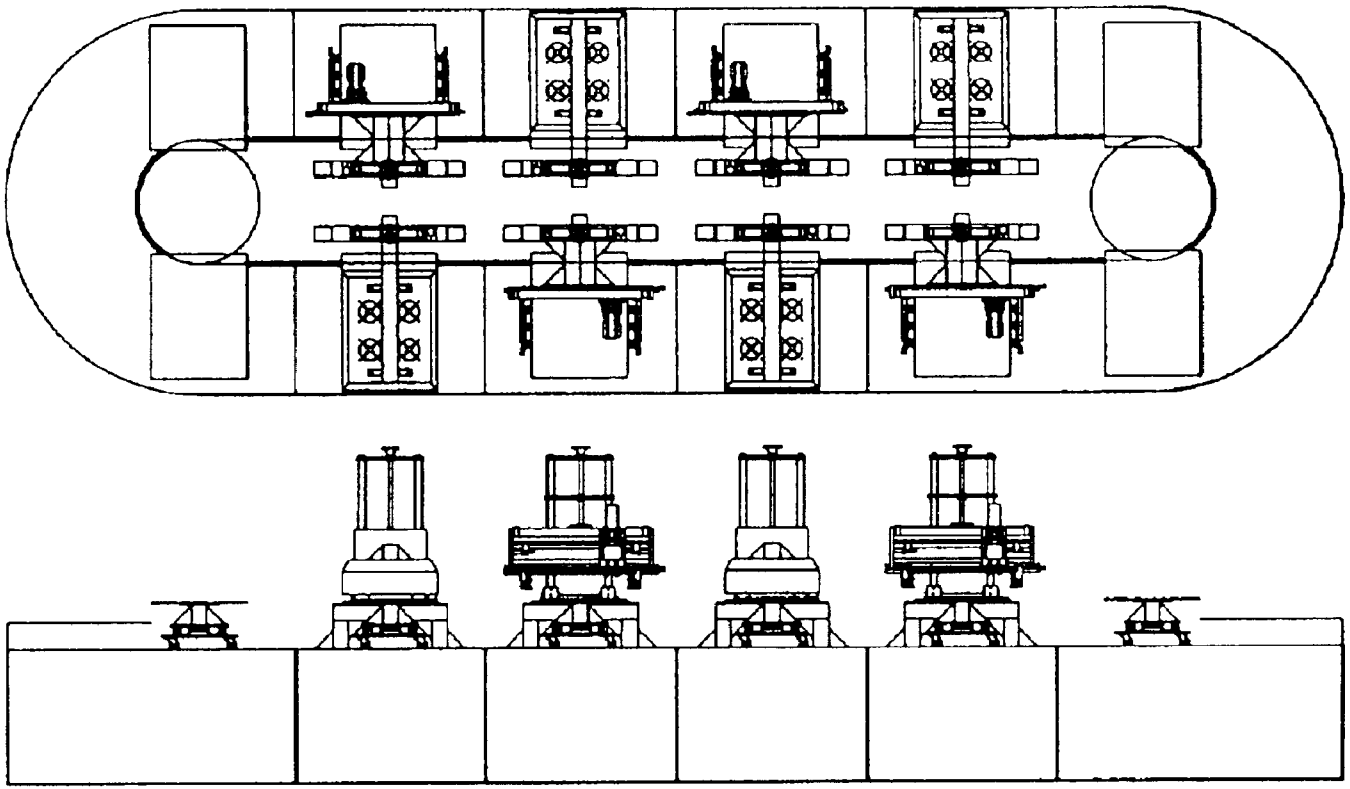
FIG. 4 is similar to FIG. 2 but showing the number of the rectangular machine tables reduced.
Figure 5:
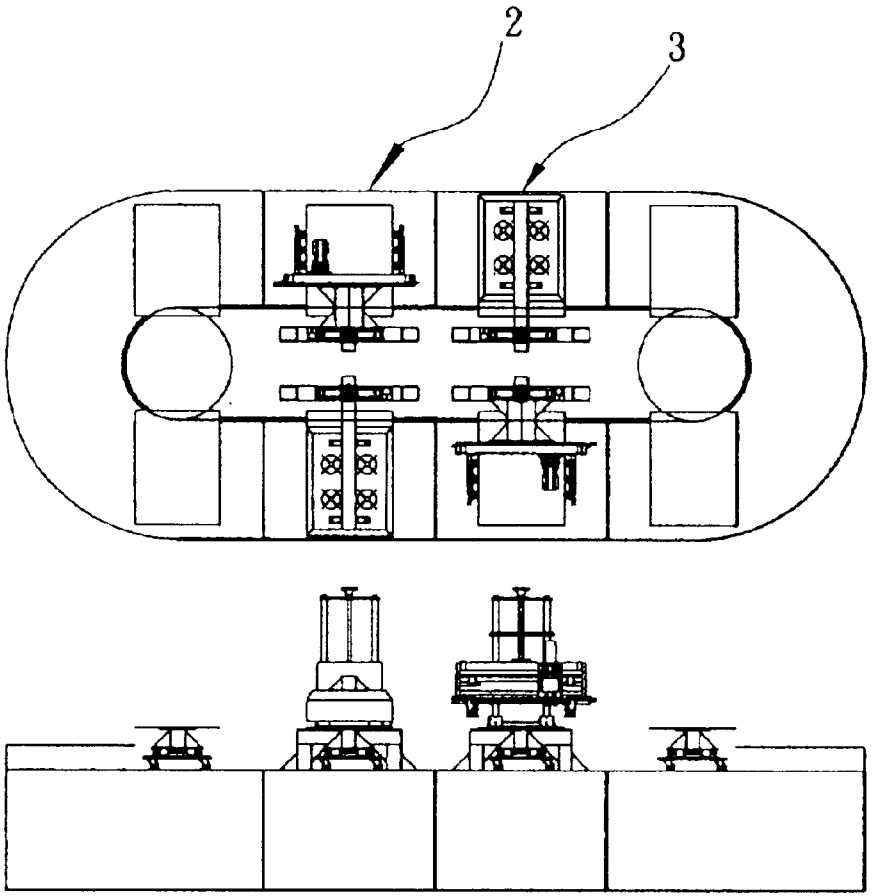
FIG. 5 is similar to FIG. 4 but showing the number of the rectangular machine tables reduced further.
Figure 6:
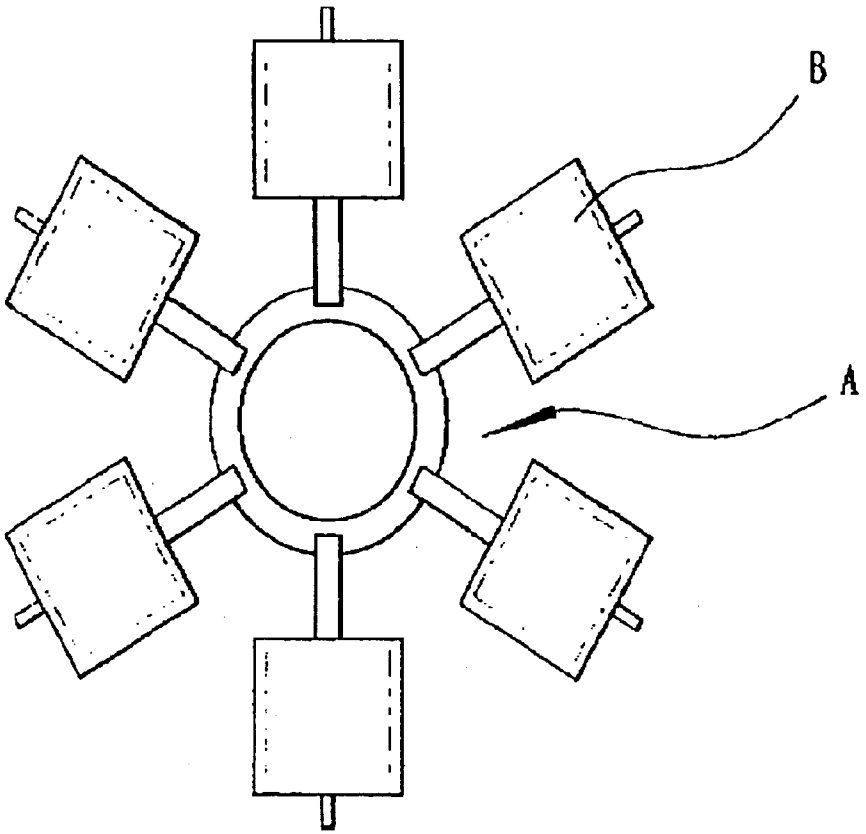
PRIOR ART FIG.6
FIG. 6 is an auto-rotary printer according to the prior art.

Before operation, the user can adjust the number of the rectangular machine tables 11 between the semicircular end tables 12 subject to actual printing requirements (see FIGS. 3~5).

A prototype of extendable auto printing and drying machine has been constructed with the features of the annexed drawings of FIGS. 1 through 5. The extendable auto printing and drying machine functions smoothly to provide all of the features discussed earlier.

Although particular embodiments of the invention have been described in detail for purposes of illustration various modifications and enhancements may be made without departing from the spirit and scope of the invention. Accordingly, the inventions is not to be limited except as by the appended claims.

What the invention claimed is:

1. An extendable auto printing and drying machine comprising:

two semicircular end tables;

a plurality of rectangular machine tables each comprising a printer and dryer unit each said printer and dryer unit comprising a printing module and a drying module bilaterally arranged at a top side thereof, said rectangular machine tables being alternatively reversely arranged in a line between said semicircular end tables, said rectangular machine tables and said semicircular end tables being each having a transmission chain mechanism, said transmission chain mechanisms form a transmission chain loop when said rectangular machine tables and said semicircular end tables are arranged together, said drying modules each comprising an infrared light source for drying a workpiece;

a plurality of carriages being respectively installed in said transmission chain mechanisms, each of said carriages having a workpiece carrier adapted to carry a piece of cloth for printing;

whereby when said extendable auto printing and drying machine is turned on, said transmission chain mechanisms are interrmittently rotated to move said carriages over said printer and dryer units for enabling said workpiece to be printed by said printing modules and dried by drying modules.

* * * * *